United States Patent [19]

Ishikawa et al.

[11] Patent Number: 5,072,690

[45] Date of Patent: Dec. 17, 1991

[54] DEVELOPING DEVICE OF ELECTROPHOTOGRAPHIC PRINTER

[75] Inventors: Yasushi Ishikawa; Fumio Tomono; Tetsuya Fujita, all of Tokyo, Japan

[73] Assignee: Seikosha Co., Ltd., Tokyo, Japan

[21] Appl. No.: 686,640

[22] Filed: Apr. 17, 1991

[30] Foreign Application Priority Data

Apr. 27, 1990 [JP] Japan ..... 2-113679
Jun. 28, 1990 [JP] Japan ..... 2-68833[U]

[51] Int. Cl.[5] ..... G03G 15/09

[52] U.S. Cl. ..... 118/658; 118/657; 355/251; 355/253

[58] Field of Search ..... 118/653, 656-658; 355/245, 251, 253

[56] References Cited

U.S. PATENT DOCUMENTS 4,213,617 7/1980 Salger ..... 118/658 X
4,233,935 11/1980 Uehara ..... 118/657
4,876,574 10/1989 Tajima et al. ..... 355/253

FOREIGN PATENT DOCUMENTS 0114561 7/1984 Japan ..... 355/253
0204870 11/1984 Japan ..... 355/251
0003152 1/1986 Japan ..... 355/251
0219065 9/1986 Japan ..... 355/251

OTHER PUBLICATIONS

IBM Technical Disclosure Bulletin, vol. 1, No. 3, p. 6, Oct. 1958, Schaffert, R. M., "Development of Electrostatic Images".

*Primary Examiner*—A. T. Grimley
*Assistant Examiner*—Matthew S. Smith
*Attorney, Agent, or Firm*—Jordan and Hamburg

[57] ABSTRACT

A developing device for use in an electrophotographic printer comprises a non-magnetic cylindrical developing sleeve for conveying magnetic toner on its surface in rotating condition, a toner supply unit for supplying the magnetic toner onto the developing sleeve, a fixed magnetic field generating member disposed inside the developing sleeve, and a doctor blade unit disposed in confronting relation to the surface of the developing sleeve for regulating the layer thickness of the magnetic toner. The doctor blade unit includes a pair of magnetic pole plates whose distal ends are spaced a given distance from each other and magnetized as to exhibit opposite magnetic polarities. The fixed magnetic field generating member has a notch formed in a section facing the magnetic pole plates such that its magnetic flux does not act virtually on the magnetic pole plates.

13 Claims, 2 Drawing Sheets

DEVELOPING DEVICE OF ELECTROPHOTOGRAPHIC PRINTER

BACKGROUND OF THE INVENTION

1. Field of the Invention

This invention relates to a developing device for use in an electrophotographic printer.

2. Description of the Prior Art

In the prior art, Japanese Patent Publication No. 59-8831 discloses a device characterized in that a fixed magnetic field generating means is disposed inside a moving toner support means, a magnetic member for regulating the layer thickness of magnetic toner is disposed outside the toner support means, i.e. on the opposite side of the magnetic field generating means, and a stationary magnetic field is generated between the fixed magnetic field generating means and the magnetic member as to spread across the toner support means (sleeve). In this device, the magnetic toner expected to stay in the stationary magnetic field is drawn out in response to the movement of the toner support means, so that a thin layer of magnetic toner is formed on the surface of the toner support means.

Japanese Patent Publication No. 61-48157 discloses a device comprising a developing magnetic pole corresponding to the foregoing fixed magnetic field generating means, a member corresponding to the foregoing toner support means, a means for supplying toner onto the periphery of the member, a doctor blade for controlling the amount of toner being supplied, and a counter magnetic pole plate made of magnetic material disposed between the doctor blade and the developing zone, wherein a curtain defined by magnetic lines of force is formed between the developing magnetic pole and the counter magnetic pole plate.

Further, Japanese Patent Publication No. 63-789 discloses a device characterized in that the layer thickness of toner is regulated by a rigid blade disposed in confronting relation to the toner support means.

In the first prior device, since the stationary magnetic field generated by the fixed magnetic field generating means and the magnetic member is strong, the magnetic toner is readily conveyed up to the stationary magnetic field in response to the movement of the toner support means; but, only a little amount of magnetic toner can be drawn out from the stationary magnetic field because the force of staying there is strong. Therefore, although this device is advantageous in forming a thin layer of magnetic toner, the amount of magnetic toner staying in the stationary magnetic field increases, resulting in an aggregation of magnetic toner. In this state, if the magnetic toner is drawn out, the density of the magnetic toner thus drawn out fluctuates, making printed characters nonuniform.

Further, since the stationary magnetic field is generated by the fixed magnetic field generating means and the magnetic member, the distance between them must be adjusted finely, making device assembly difficult.

In the second prior device, since the gap between the doctor blade and the sleeve is narrow, if foreign matter such as dust included in the toner gets in the gap and causes clogging, such a clogged portion prevents supply of the toner. As a result, a portion of the surface of the sleeve bears no toner, resulting in a corresponding blank stripe on a developed picture.

Further, to form the curtain of magnetic line of force between the developing magnetic pole and the counter magnetic pole plate, the distance between them must be adjusted finely, making assembly difficult.

In the third prior device, the layer thickness of the toner is influenced by the width and surface roughness of the end face of the blade which faces the sleeve.

SUMMARY OF THE INVENTION

It is an object of the present invention to provide a developing device of simple structure which can form a very thin and uniform layer of toner even where the gap between a sleeve and a doctor blade is comparatively wide.

To accomplish the foregoing object, a developing device for use in an electrophotographic printer according to the present invention comprises a non-magnetic cylindrical developing sleeve for supporting magnetic toner on its surface and conveying the same in rotating condition, toner supply means for supplying the magnetic toner onto the developing sleeve, fixed magnetic field generating means disposed inside the developing sleeve, and doctor blade means disposed in confronting relation to the surface of the developing sleeve for regulating the layer thickness of the magnetic toner. The developing device is characterized in that the doctor blade means is made of a pair of magnetic pole plates whose distal ends are spaced a given distance from each other and magnetized as to exhibit opposite magnetic polarities, and the fixed magnetic field generating means has a notch formed in a section facing the magnetic pole plates such that the magnetic flux generated by the fixed magnetic field generating means does not act virtually on the magnetic pole plates. It is preferable that the surface roughness of the developing sleeve be no larger than 8 $\mu$m.

Since the fixed magnetic field generating means is partly cut out in a section facing the magnetic pole plates, the magnetic flux generated by the fixed magnetic field generating means does not act on the pair of magnetic pole plates. Since the doctor blade means is made of the pair of magnetic pole plates whose distal ends are spaced a given distance from each other and magnetized so as to exhibit opposite magnetic polarities, a magnetic field is formed by virtue of the leakage flux of the pair of magnetic poles, and by this magnetic field, the toner is magnetically shielded. Therefore, only a definite amount of toner lying close to the sleeve surface and electrified through rubbing with the sleeve is changed into the form of a thin layer on the sleeve and conveyed by the sleeve.

Further, since the layer of magnetic toner is formed on the sleeve by virtue of the leakage flux of the magnetic poles, the layer thickness of the toner is not influenced by the distance (doctor gap) between the doctor blade means and the developing sleeve and the surface roughness of the blade, and the layer thickness of the magnetic toner on the sleeve is substantially unchanged even when the doctor gap is changed. Thus, the position of the doctor gap can be adjusted simply.

DESCRIPTION OF THE PREFERRED EMBODIMENTS

Embodiments of the present invention will now be described with reference to the drawings.

Figure 1:
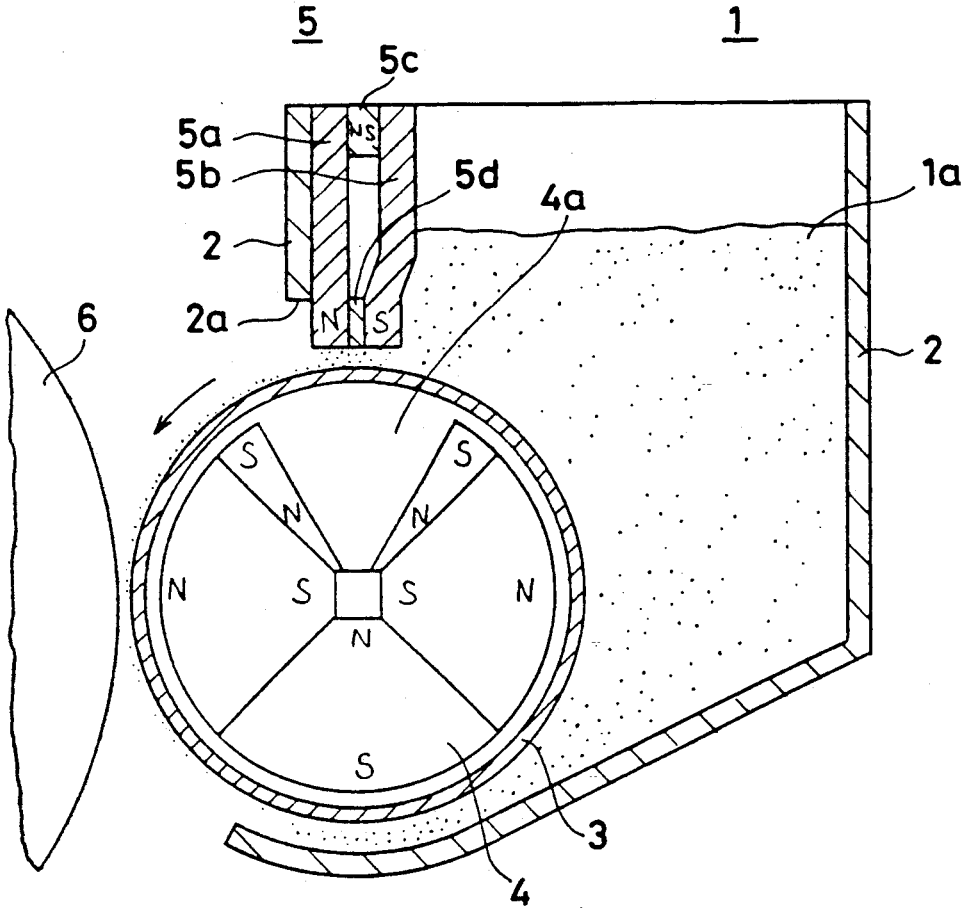
FIG. 1 is a fragmentary sectional view showing an embodiment of the present invention.

As shown in FIG. 1, a toner supply means 1 comprises a toner case 2 in which magnetic toner 1*a* is stored, and a non-magnetic cylindrical developing sleeve 3 is rotatably supported inside the toner case. The surface roughness of the sleeve 3 is no larger than 8 μm. The outer periphery of the sleeve 3 is partly exposed. The magnetic toner 1*a* is supported on the surface of the cylindrical developing sleeve 3 and, in response to the rotation of the sleeve, is carried out through an opening portion 2*a* of the toner case 2.

A fixed magnetic field generating means 4 is disposed inside the cylindrical developing sleeve 3. This fixed magnetic field generating means 4 is made of a columnar magnet having an axial notch 4*a* formed in a section facing magnetic pole plates 5*a* and 5*b* described hereinafter, and the periphery of this magnet 4 is magnetized such that a number of magnetic polarities N and S are exhibited alternately in the circumferential direction. The section of the axial notch 4*a* has no magnetic pole.

In association with the opening portion 2*a* of the toner case, a doctor blade means 5 is disposed in confronting relation to the surface of the developing sleeve 3 with a given distance left between them. This doctor blade means 5 is provided to regulate the layer thickness of the magnetic toner 1*a*, and thus is composed of a pair of magnetic pole plates 5*a* and 5*b* spaced a given distance from each other and a permanent magnet 5*c* interposed between the two magnetic pole plates close to the base ends thereof, so that the respective distal ends of the two magnetic pole plates 5*a* and 5*b* exhibit opposite magnetic polarities. A spacer 5*d* made of non-magnetic material is interposed between the distal ends of the two magnetic pole plates.

Since the axial notch 4*a* of the fixed magnetic field generating means 4 is formed in alignment with the distal ends of the two magnetic pole plates 5*a* and 5*b*, the magnetic flux generated by the fixed magnetic field generating means 4 does not act on the two magnetic pole plates 5*a* and 5*b*.

In the path of the magnetic toner 1*a*, whose layer thickness is regulated to a small value, being conveyed in attached condition to the developing sleeve 3, a photoconductive drum 6 is disposed in confronting relation to the developing sleeve 3 with a given distance left between them.

How the magnetic toner 1*a* is conveyed to the position where it faces the photoconductive drum 6 will be described.

Figure 2:
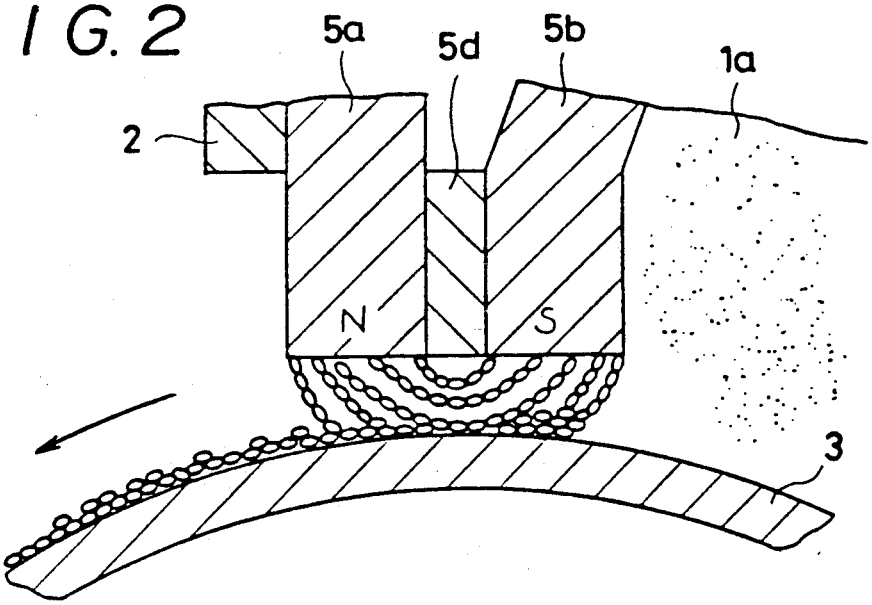
FIG. 2 is an enlarged fragmentary sectional view explanatory of the principle of the present invention.

First, the magnetic toner 1*a* stored in the toner case 2 stands up in line with the magnetic field generated by the fixed magnetic field generating means 4, and in response to the rotation of the cylindrical developing sleeve 3, is conveyed to the vicinity of the doctor blade means 5 while being attached to the surface of the cylindrical developing sleeve. In the vicinity of the doctor blade means 5, since the fixed magnetic field generating means 4 has only the axial notch 4*a*, a magnetic field is formed between the distal ends of the magnetic pole plates 5*a* and 5*b* by virtue of the leakage flux as shown in FIG. 2; therefore, the toner case 2 is magnetically shielded. The magnetic toner 1*a* conveyed to this position is freed from the influence of the magnetic field generated by the fixed magnetic field generating means 4, and thus is aligned in line with the magnetic field generated by the magnetic pole plates 5*a* and 5*b*. Since the cylindrical developing sleeve 3 continues rotating, rubbing occurs between the sleeve surface and the magnetic toner 1*a*, so that the magnetic toner 1*a* kept in contact with the developing sleeve 3 undergoes frictional electrification, thus adheres to the sleeve surface in the form of a thin layer. Only the magnetic toner 1*a* adhering to the sleeve surface passes through the shielded zone in response to the rotation of the developing sleeve 3 to come to a developing position where it faces the photoconductive drum 6.

Since the magnetic toner 1*a* thus adhering to the surface of the cylindrical developing sleeve 3 consists only of particles electrified through rubbing with the sleeve, there is formed a thin uniform layer of magnetic toner. Where the spacing (doctor gap) between the doctor blade means 5 and the developing sleeve 3 is to be enlarged, the purpose of forming a thin layer of magnetic toner 1*a* can be attained by increasing the flux density of the magnetic field generated by the magnetic pole plates 5*a* and 5*b*.

The spacer 5*d* is made of paramagnetic metal such as brass, plastic such as "Mylar", ceramic, glass, etc.

To prevent the occurrence of electric discharging between the doctor blade means 5 and the cylindrical developing sleeve 3 when chains of magnetic toner 1*a* caused by the magnetic field generated by the magnetic pole plates 5*a* and 5*b* are released, the doctor blade means 5 and the cylindrical developing sleeve 3 are kept at the same potential.

Figure 4:
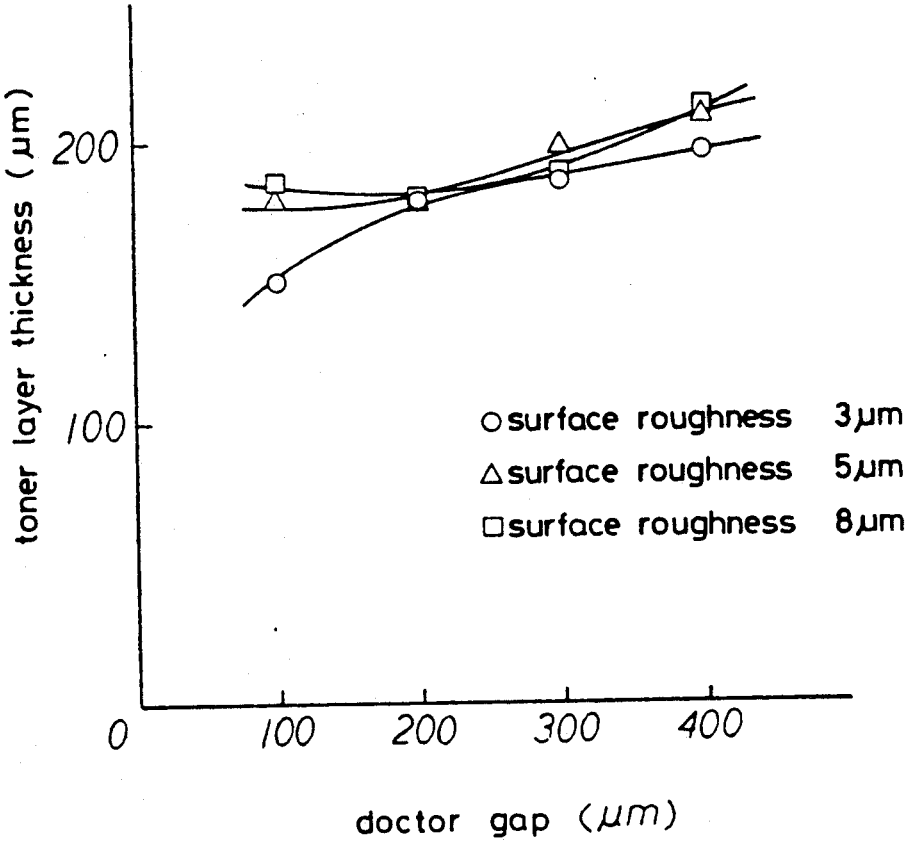
FIG. 4 is a graph showing the relationship between toner layer thickness and doctor gap in relation to the surface roughness of a cylindrical developing sleeve.

FIG. 4 is a graph showing the variation in thickness of the toner layer on the cylindrical developing sleeve 3 at the developing position as obtained by changing the size of the doctor gap. In this graph, the surface roughness of the cylindrical developing sleeve 3 was set to 3 μm, 5 μm, and 8 μm. From FIG. 4, it will be understood that according to the present invention, the layer of magnetic toner is formed on the sleeve by virtue of the leakage flux generated by the magnetic pole plates; thus, the influence of the variation in doctor gap size on the thickness of the toner layer is not significant in the foregoing three cases of surface roughness.

Figure 3:
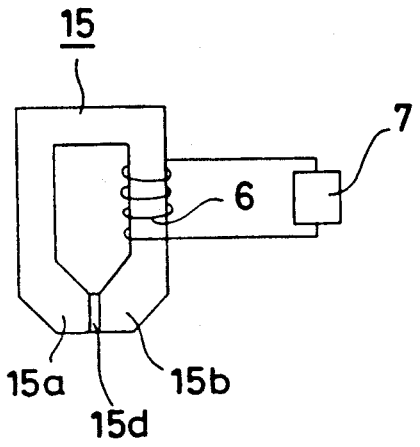
FIG. 3 is a fragmentary sectional view showing another embodiment of the present invention.

The permanent magnet 5*c* is not necessarily required to cause the pair of magnetic pole plates to exhibit opposite magnetic polarities. That is, in FIG. 3, one ferromagnetic member 15 (the doctor blade means) is shaped as to define a pair of opposing portions 15*a* and 15*b*, and a coil 6 is provided around the ferromagnetic member 15. The coil 6 is connected to a driving circuit 7 as to be energized thereby. Similarly to the first embodiment, a non-magnetic gap spacer 15*d* is interposed between the opposing portions 15*a* and 15*b*.

When the coil 6 is energized by the driving circuit 7, a magnetic path is formed within the ferromagnetic member 15 to magnetize the opposing portions 15*a* and 15*b* as to exhibit opposite magnetic polarities, whereby a magnetic field is formed between the opposing portions by virtue of a leakage flux. The surface roughness of the cylindrical developing sleeve should not be limited to the foregoing values.

As described above, the present invention forms the layer of magnetic toner on the cylindrical developing sleeve by virtue of the leakage flux of the magnetic poles; thus, the thickness of the toner layer is not influenced by the doctor gap and the blade surface roughness, the layer thickness of the magnetic toner on the cylindrical developing sleeve is substantially unchanged even if the size of the doctor gap is changed, and therefore, the position of the doctor gap can be adjusted simply.

Further, even where the distance between the doctor blade means and the surface of the cylindrical developing sleeve is comparatively large, a very thin and uniform layer of magnetic toner can be formed; thus, the magnetic toner is never aggregated at the opening portion through which the magnetic toner is conveyed, the opening portion is not clogged with foreign matter, and therefore, fine printing can always be performed reliably. Further, the device is simple in structure, thus can be marketed at low cost.

What we claim is:

1. A developing device for use in an electrophotographic printer comprising a non-magnetic cylindrical developing sleeve for supporting magnetic toner on its surface and conveying the same in a rotating condition, toner supply means for supplying the magnetic toner onto said developing sleeve, fixed magnetic field generating means disposed inside said developing sleeve, doctor blade means disposed in confronting relation to the surface of said developing sleeve for regulating the layer thickness of the magnetic toner, said doctor blade means being made of a pair of magnetic members whose distal ends are spaced a given distance from each other and magnetized as to exhibit opposite magnetic polarities, said fixed magnetic field generating means having a notch formed in a section facing said magnetic members such that the magnetic flux generated by said fixed magnetic field generating means does not act virtually on said magnetic members.

2. A developing device according to claim 1, wherein the surface roughness of said developing sleeve is no larger than 8 μm.

3. A developing device according to claim 1, wherein said magnetic members generate a magnetic field in the area between said doctor blade means and said sleeve which is operable to align the magnetic toner with said magnetic field in said area.

4. A developing device according to claim 3, wherein said notch in said fixed magnetic field generating means is juxtaposed to said area to free the magnetic toner in said area from the influence of the magnetic field generated by said fixed magnetic field generating means.

5. A developing device according to claim 1, wherein said magnetic members generate a leakage flux which forms a layer of magnetic toner on said sleeve.

6. A developing device according to claim 1, wherein said fixed magnetic field generating means is operable to attach said magnetic toner to said sleeve so that the rotating sleeve carries the attached magnetic toner to a position juxtaposed to said notch.

7. A developing device according to claim 1, wherein said fixed magnetic field generating means comprises a columnar magnet having said notch, said columnar magnet having a periphery having a plurality of alternate polarities along said periphery.

8. A developing device according to claim 1, wherein said doctor blade means comprises a permanent magnetic between said pair of magnetic members.

9. A developing device according to claim 1, wherein said doctor blade means further comprises a non-magnetic spacer between said magnetic members.

10. A developing device according to claim 1, wherein said magnetic members have a proximal end and a distal end, said doctor blade means further comprising a non-magnetic spacer between said magnetic members at said distal ends.

11. A developing device according to claim 1, wherein said doctor blade means comprises an energizing coil.

12. A developing device according to claim 1, wherein said doctor blade means comprises a ferromagnetic structure formed to have said pair of magnetic members, and a coil about at least a part of said ferromagnetic structure for causing said pair of magnetic members to exhibit opposite magnetic polarities.

13. A developing device comprising a non-magnetic cylindrical developing sleeve for supporting magnetic toner on its surface and conveying the same in a rotating condition, toner supply means for supplying the magnetic toner onto said sleeve, fixed magnetic field generating means disposed inside said sleeve, and doctor blade means disposed in confronting relation to the surface of said sleeve for regulating the layer thickness of the magnetic toner, said doctor blade means comprising a pair of magnetic members having ends spaced from each other and magnetized so as to exhibit opposite magnetic polarities, said fixed magnetic field generating means having a notch facing said magnetic members to substantially free the magnetic toner from the influence of the magnetic field generated by said fixed magnetic field generating means as the leakage flux generated by said magnetic members forms a layer of magnetic toner on said sleeve.

* * * * *